US011518164B2

(12) United States Patent
Ozaki

(10) Patent No.: US 11,518,164 B2
(45) Date of Patent: Dec. 6, 2022

(54) SUBSTRATE WITH ELECTRICAL CONNECTION SECTION, SUBSTRATE FOR LIQUID EJECTION HEAD AND METHODS OF MANUFACTURING THE SAME

(71) Applicant: CANON KABUSHIKI KAISHA, Tokyo (JP)

(72) Inventor: Teruo Ozaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 17/005,109

(22) Filed: Aug. 27, 2020

(65) Prior Publication Data

US 2021/0060938 A1 Mar. 4, 2021

(30) Foreign Application Priority Data

Aug. 30, 2019 (JP) ..... JP2019-158553

(51) Int. Cl.
*B41J 2/14* (2006.01)
*B41J 2/16* (2006.01)

(52) U.S. Cl.
CPC ..... *B41J 2/14* (2013.01); *B41J 2/1626* (2013.01); *B41J 2/1642* (2013.01); *B41J 2002/14491* (2013.01)

(58) Field of Classification Search
CPC . B41J 2/14; B41J 2/1626; B41J 2/1642; B41J 2002/14491; B41J 2/1603; B41J 2/1629; B41J 2/1631; B41J 2/1639; B41J 2/1643; B41J 2/1645; B41J 2/1646; B41J 2/1628
See application file for complete search history.

(56) References Cited

FOREIGN PATENT DOCUMENTS

JP 2003-215024 A 7/2003
JP 2007-251158 A 9/2007

OTHER PUBLICATIONS

IP.com search (Year: 2022).*

* cited by examiner

*Primary Examiner* — Lisa Solomon
(74) *Attorney, Agent, or Firm* — Canon U.S.A., Inc., IP Division

(57) ABSTRACT

A substrate with an electrical connection section or a substrate for liquid ejection head comprises a wiring layer, a diffusion prevention layer laid on the wiring layer and a connection member laid on the diffusion prevention layer for establishing an electrical connection to an outside. An insulation layer having a wiring-layer-exposing opening is arranged on the wiring layer and the diffusion prevention layer is arranged in the opening, while the connection member is arranged on the diffusion prevention layer so as to cover an outer peripheral edge of the diffusion prevention layer.

8 Claims, 12 Drawing Sheets

SUBSTRATE WITH ELECTRICAL CONNECTION SECTION, SUBSTRATE FOR LIQUID EJECTION HEAD AND METHODS OF MANUFACTURING THE SAME

BACKGROUND OF THE INVENTION

Field of the Invention

The present disclosure relates to a substrate with an electrical connection section, a substrate for liquid ejection head and methods of manufacturing such substrates.

Description of the Related Art

A substrate for liquid ejection head, which is a principal component of an inkjet head, has a configuration as will be described hereinafter by referring to FIGS. 1 and 2. Electric wiring, a member 523 having liquid chambers 520 to be filled with ink and ejection orifices 508 for ejecting ink and other members are formed on the front surface 502 of a substrate 501 by means of a film forming technique. Typically, an Si substrate having a thickness between 0.3 and 1.0 mm is employed for the substrate 501. An ink supply port 503, which is an oblong groove-like through hole for receiving liquid fed from the outside and guiding the liquid into the liquid chambers 520, is open at the front surface 502 of the substrate 501. A row of liquid ejection energy generating elements 504 is arranged on each of the opposite sides of the ink supply port 503 on the substrate front surface 502. The liquid ejection energy generating elements 504 are arranged at respective positions that correspond to the liquid chambers.

Each of the liquid chambers 520 is so formed as to communicates with the ink supply port 503 and contain the corresponding liquid ejection energy generating elements 504 of the two rows of liquid ejection energy generating elements 504 that are arranged respectively on the opposite sides of the ink supply port 503. Each of the liquid chambers 520 is surrounded by a flow path wall 507 that defines an ink flow path, whose cross section extends from the ink supply port 503 and gets to a position located above the rows of liquid ejection energy generating elements 504. The ejection orifices 508 are open above the respective liquid ejection energy generating elements.

Additionally, an electric wiring layer 509, which is typically made of aluminum (Al), is formed on the substrate front surface 502 by way of an insulating oxide film layer 515 in order to supply electric power to the liquid ejection energy generating elements 504. The electric wiring layer 509 has a plurality of electrode sections 505 that are connected to an external electric power supply source. The electrode sections 505 are arranged in two rows running along the respective edges of the substrate in the longitudinal direction of the substrate (and in the direction running along the ink supply port). Connection members (electrode pads) 506 that are typically made of gold (Au) are arranged respectively on the electrode sections 505 with a diffusion prevention layer 510 interposed between the connection members 506 and the electrode sections 505.

When forming Au connection members 506, a diffusion prevention layer 510 is arranged between the electrode sections 505 and the Au connection members 506 in order to minimize degradation of the connection reliability of the Au connection members 506 due to diffusion of Al of the electrode sections 505 into the Au of the connection members 506. The diffusion prevention layer is formed by using a metal material such as TiW or the like. The Au connection members 506 are generally formed on the diffusion prevention layer 510 by means of sputtering or bump plating of Au. If the Au connection members 506 are formed after forming the liquid chambers and executing the process of forming the ink supply port, it is difficult to execute a highly accurate process, using photolithography, because holes and steps of 5 to 100 μm are already present on the substrate. For this reason, the manufacturing step of forming Au connection members is conducted first and thereafter the ink flow paths and the liquid chambers 520 are formed and the process of forming the ink supply port 503 is executed.

Japanese Patent Application Laid-Open No. 2007-251158 describes a connector structure that includes a diffusion prevention film pattern as a structure for electrically connecting a semiconductor chip and a mounting board. More specifically, the structure comprises a substrate, electroconductive pads containing Au and formed on the substrate, an antireflection film pattern formed on the edge parts of the electroconductive pads and a diffusion prevention film pattern formed on both the antireflection film pattern and the electroconductive pads. Additionally, it further comprises a sacrificial film pattern for separating the antireflection film pattern and the diffusion prevention film pattern, a seed film pattern arranged on the antireflection film pattern and bumps arranged on the seed film pattern.

Meanwhile, Japanese Patent Application Laid-Open No. 2003-215024 describes a technique relating to a method of predicting the amount of corrosion of a metal material attributable to contact corrosion between dissimilar metals. Contact corrosion between dissimilar metals is a phenomenon where the base metal of two different metals is preferentially corroded. The above-cited patent literature describes that contact corrosion between dissimilar metals more often than not severely damages various structures.

However, the techniques of the above-cited patent literatures are not necessarily satisfactory when they are applied to a method of manufacturing a substrate with an electrical connection section that can be employed for semiconductor devices, micromachining devices and liquid ejection heads such as a substrate for liquid ejection head for the reasons that will be described below.

When a wet etching process using photolithography is executed to conduct a processing operation on a diffusion prevention layer in a step of forming an electrical connection section, the diffusion prevention layer that shows an ionization tendency that is more remarkable than the Au connection members contacts the connection members. Therefore, during the wet etching process that is being executed on the diffusion prevention layer, the etching rate rises and the diffusion prevention layer located right under the Au connection members is rapidly etched due to contact corrosion between two dissimilar metals. Then, as a result, the diffusion prevention layer 510 will be undercut under the outer peripheral parts of the Au connection members 506 to give rise to flaws to the Au connection members 506.

Flawed Au connection members are apt to fall out in subsequent steps to simply turn to be foreign objects, which in turn can give rise to electric short-circuiting and obstruct the formation of liquid chambers and ink flow paths. Additionally, the phenomenon of undercutting of the diffusion prevention layer can progress in subsequent steps to give rise to corrosion of the underlying wiring layer. Such corrosion can reduce the electric reliability of the finished product.

SUMMARY OF THE INVENTION

In an aspect of the present disclosure, there is provided a substrate with an electrical connection section comprising: a wiring layer; a diffusion prevention layer laid on the wiring layer; and a connection member laid on the diffusion prevention layer, the connection member establishing an electrical connection to an outside; an insulation layer having a wiring-layer-exposing opening arranged on the wiring layer; the diffusion prevention layer being arranged in the opening; the connection member being arranged on the diffusion prevention layer so as to cover an outer peripheral edge of the diffusion prevention layer.

Further features of the present disclosure will become apparent from the following description of exemplary embodiments with reference to the attached drawings.

DESCRIPTION OF THE EMBODIMENTS

An aspect of the present disclosure is to provide a substrate with a highly reliable electrical connection section and a substrate for liquid ejection head in which the diffusion prevention layer is prevented from being undercut during the wet etching process for forming connection members.

Now, an embodiment of substrate for liquid ejection head according to the present disclosure will be described below by referring to the related drawings.

Figure 3A:
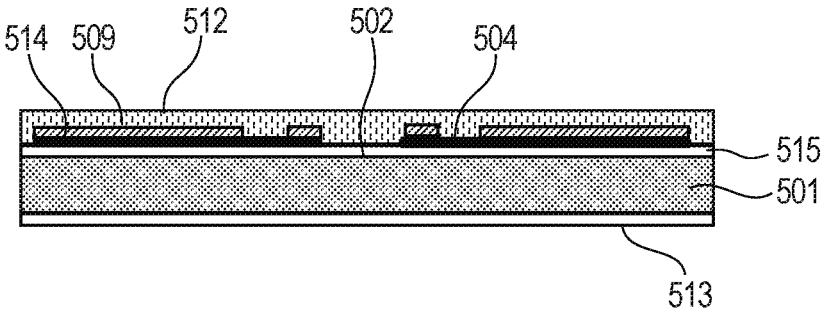
FIGS. 3A, 3B and 3C are schematic cross-sectional views of the substrate for liquid ejection head shown in FIGS. 1 and 2 in different steps of the process of exposing parts of the aluminum wiring as electrode sections of the method of manufacturing the substrate for liquid ejection head.

First, the disadvantageous phenomenon that the prior art gives rise to will be described by referring to FIGS. 3A through 3C and FIGS. 5A through 5G. FIG. 3A schematically illustrates a substrate for liquid ejection head on the way of manufacturing and in a state that a heat generating resistor layer 514, an Al wiring layer 509 and liquid ejection energy generating elements 504 are formed on the substrate 501 by way of an insulating oxide film layer 515 and a protection layer 512 is formed over these layers and elements. Then, openings are formed in the protection layer 512 for the purpose of establishing an electrical connection to the outside in a manner as described below.

Figure 3B:
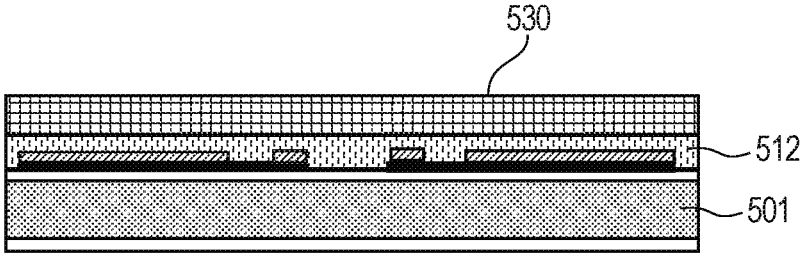

To begin with, a resist layer 530 to be used for photolithography for the purpose of opening windows in the protection layer 512 is formed on the substrate as shown in FIG. 3B.

Figure 3C:
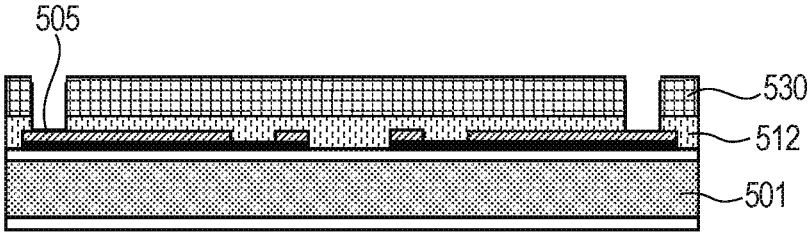

Subsequently, as shown in FIG. 3C, a resist pattern 530 is formed by partly removing the resist layer by means of photolithography and then openings are formed in the protection layer 512 by etching the protection layer 512 using the resist pattern 530 as mask. Partly exposed areas of Al wiring layer 509 in the openings turn to be electrode sections 505.

Figure 5A:
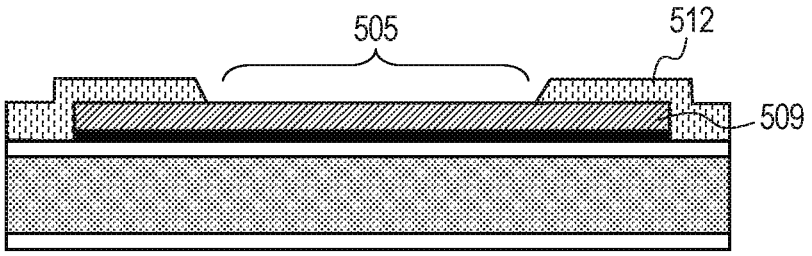
FIGS. 5A, 5B, 5C, 5D, 5E, 5F and 5G are schematic cross-sectional views of a substrate for liquid ejection head in different manufacturing steps of a related prior art method of manufacturing the substrate, illustrating the disadvantage of undercutting the diffusion prevention layer of the substrate.

Ordinarily, thereafter, the resist pattern is removed to make the substrate show a cross section as illustrated in FIG. 5A. Note here that FIGS. 5A through 5G are enlarged cross-sectional views of one of the electrode sections and its vicinity shown there to make the processing steps for forming the electrode sections 505 shown in FIG. 2 and FIG. 3C easily visually understandable (cross-sectional views taken along a plane that is perpendicular to the line 2-2 in FIG. 1).

Figure 5B:
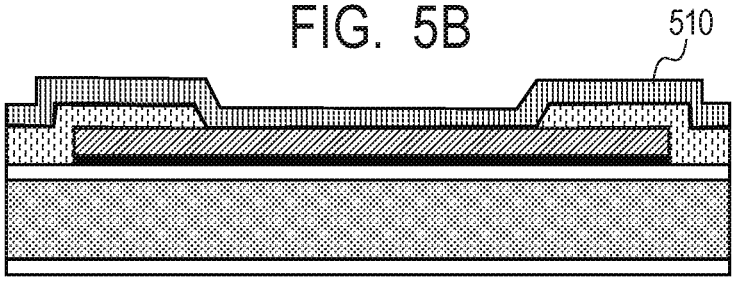
Figure 5C:
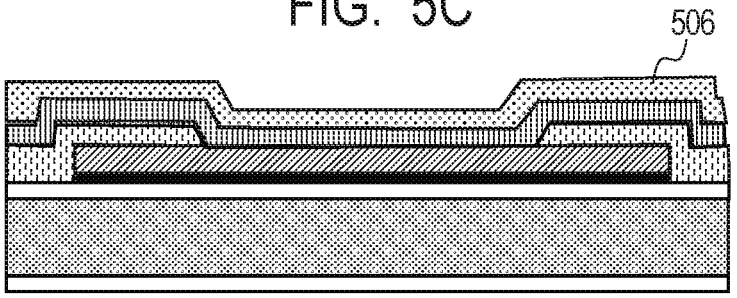

Highly reliable connection members (an Au layer) 506 are formed to establish an electrical connection to the outside by way of the diffusion prevention layer 510. Since Au is highly reliable but shows a high diffusion coefficient, the connection reliability of the connection members 506 falls if the Au of the Au layer 506 diffuses into the Al. In view of this disadvantage, the diffusion prevention layer 510 is formed before forming the Au layer as shown in FIG. 5B to minimize the diffusion of the Au of the Au layer to be formed and subsequently the Au layer 506 is actually formed by sputtering as shown in FIG. 5C.

Figure 5D:
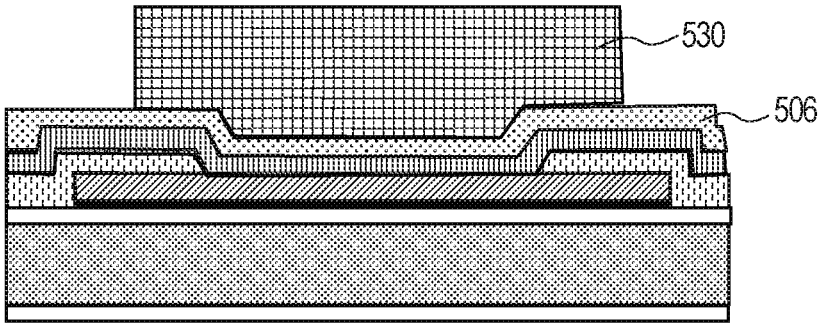

Thereafter, with regard to the part of the substrate shown in FIGS. 5A through 5G, resist is applied to the front surface of the substrate as shown in FIG. 5D and the resist pattern 530 is produced by means of a patterning operation, using photolithography, in order to protect only the region where the electrode section 505 is to be formed.

Figure 5E:
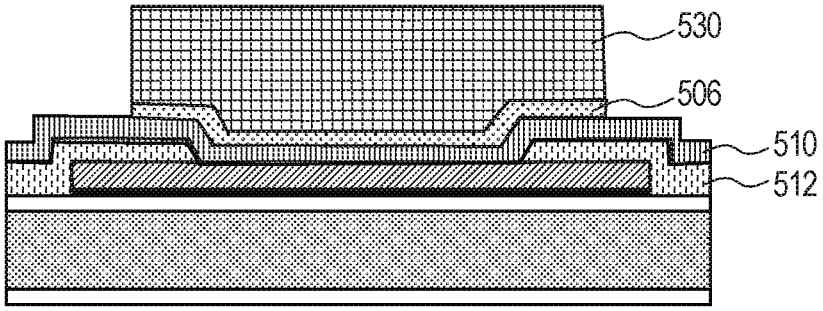
Figure 5F:
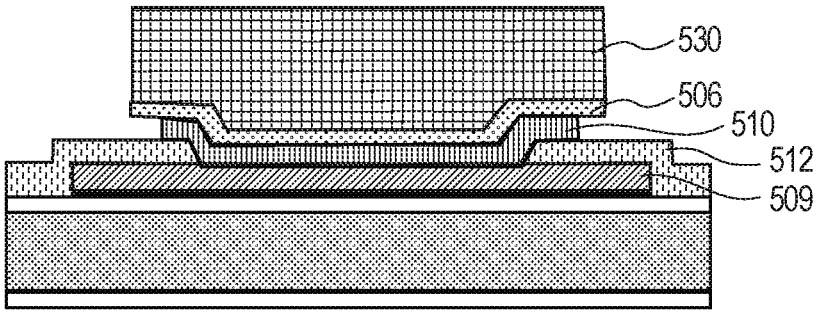
Figure 5G:
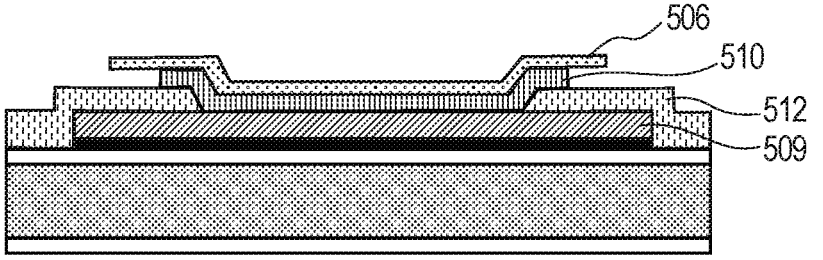

Then, as shown in FIG. 5E, the part of the Au layer that is not protected is removed by etching to make the Au layer show a predetermined profile and produce an Au connection member (electrode pad) 506. Then, the diffusion prevention layer 510 is made to show a predetermined profile as shown in FIG. 5F by means of wet etching.

Note, however, that the diffusion prevention layer (TiW layer) 510 and the Au connection member 506 are immersed into liquid while they are held in contact with each other, during the wet etching process. For this reason, a potential difference arises between the Au, which is a precious metal, and the TiW to consequently raise the etching rate of the TiW layer due to the effect of galvanic corrosion (contact corrosion between dissimilar metals). As a result, undercutting (side etching) takes place on the TiW layer. Then, consequently, a gap is produced between the layer on the side of the substrate (protection layer 512) and the Au connection member 506.

Then, as the resist pattern 530 is moved away, a flaw appears on the edge of the Au connection member 506 and the flawed part of the Au connection member located on the gap can fall down. Particularly, when a thin Au layer having a thickness of between 50 and 500 nm such as the Au layer that is formed by sputtering, the edge part of the Au connection member is apt to be broken and peeled off, if partly, somewhere in the subsequent steps. Then, such a broken and peeled off part will give rise to electrical short-circuiting and/or simply turn to be a foreign object that obstructs the operation of forming liquid chambers and ink flow paths. Additionally, the chemical liquid and the resist stripping liquid that will be employed for the operation of forming liquid chambers and for the operation of processing the ink supply port can penetrate into the space (gap) located under the flawed part to consequently contaminate the substrate.

Furthermore, the undercutting that has taken place can progress further in the presence of the chemical liquid and the resist stripping liquid employed for the operation of forming liquid chambers and for the operation of processing the ink supply port somewhere in the subsequent steps due to the effect of contact corrosion between dissimilar metals. More specifically, just like in the operation of etching the diffusion prevention layer (TiW layer) 510, the undercutting of the diffusion prevention layer (TiW layer) can progress due to the effect of contact corrosion between dissimilar metals and get to the electrode section 505 of the Al wiring layer to give rise to Al corrosion.

Figure 4A:
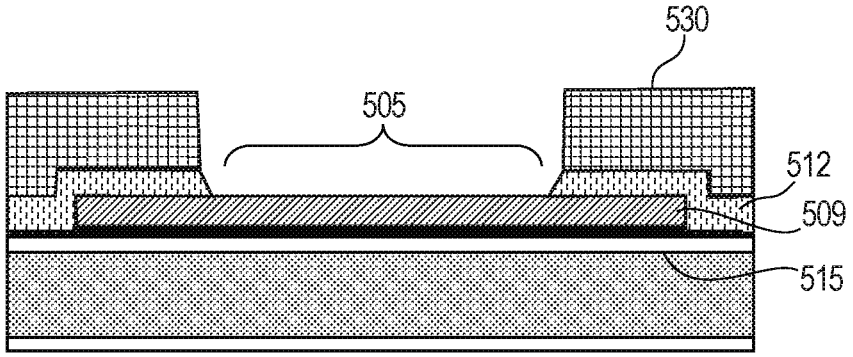
FIGS. 4A, 4B, 4C, 4D, 4E, 4F, 4G, 4H, 4I, 4J, 4K, 4L, 4M, 4N, 4O, 4P, 4Q and 4R are schematic cross-sectional views of a substrate for liquid ejection head in different manufacturing steps of this embodiment of method of manufacturing the substrate for liquid ejection head.
Figure 4B:
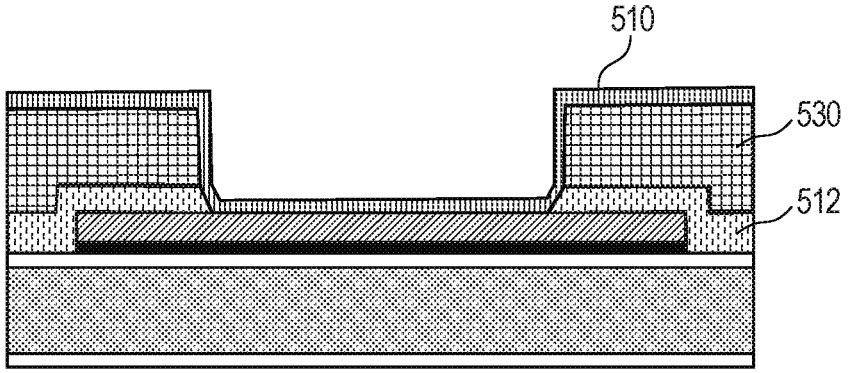
Figure 4C:
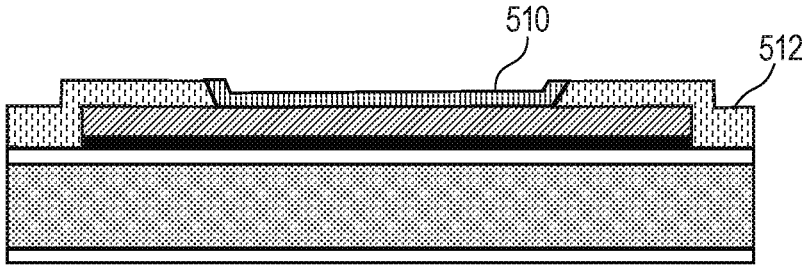
Figure 4D:
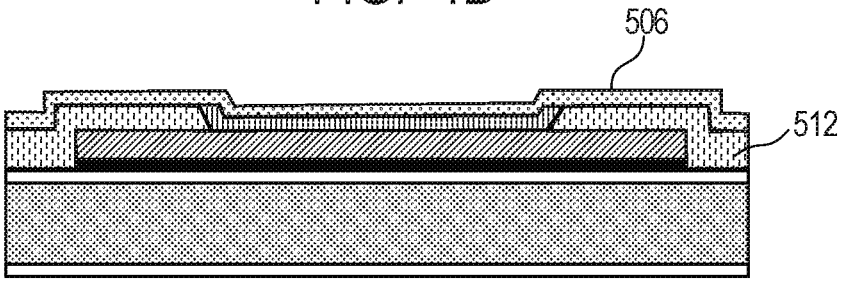
Figure 4E:
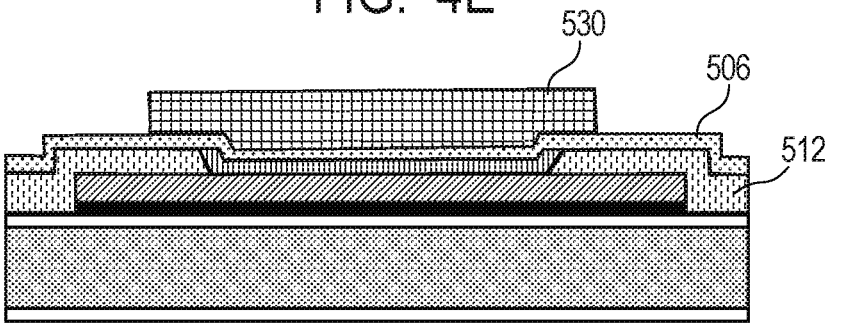
Figure 4F:
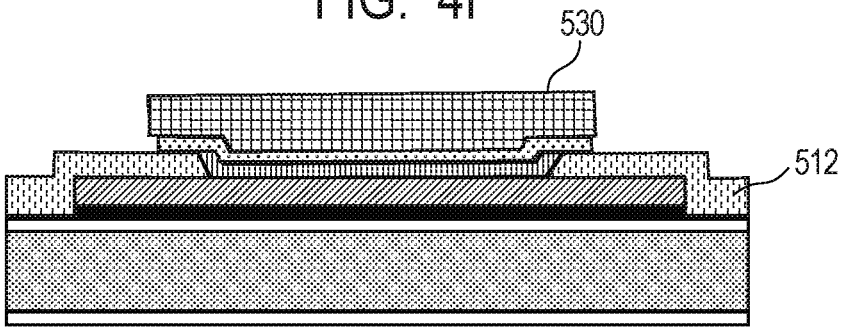
Figure 4G:
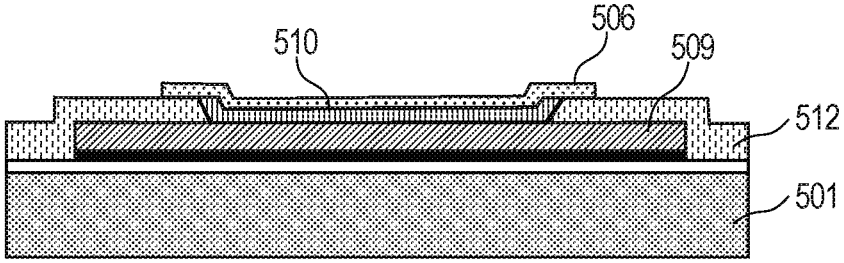

FIG. 4G shows a schematic cross-sectional view of the electrical connection section of the substrate for liquid ejection head of this embodiment of the present disclosure. More specifically, FIG. 4G is an enlarged schematic partial cross-sectional view (a cross-sectional view taken along a plane that is perpendicular to line 2-2 in FIG. 1) of the electrode section 505 and the connection member (Au electrode pad) 506 and the vicinity thereof.

As shown in FIG. 4G, a protection layer (insulation layer) 512 is formed on the substrate 501 so as to cover the electric wiring layer (Al wiring layer) 509 in this electrical connection section. Referring to FIG. 4G, an opening that exposes the electric wiring layer 509 is formed in the protection layer 512 and the diffusion prevention layer 510 is arranged on the electric wiring layer within the opening. More specifically, the diffusion prevention layer is arranged in the opening with its outer peripheral edge running along the inner periphery of the opening. Additionally and preferably, the upper surface of the outer peripheral edge of the diffusion prevention layer 510 is flush with the upper surface of the protection layer (insulation layer) 512 (in other words, the two upper surfaces are found on the same plane). To realize such a structure, the thickness of the diffusion prevention layer 510 is preferably not greater than the thickness of the protection layer 512. The connection member (electrode pad) 506 is arranged on the diffusion prevention layer that is arranged in the above-described manner so as to cover the outer peripheral edge of the diffusion prevention layer. In other words, on the surface of the substrate 501, the region of the diffusion prevention layer 510 is arranged in the inside of the region of the connection member 506 and the outer peripheral edge of the connection member 506 is arranged on the protection layer 512 formed along the outer periphery of the opening.

In the electrical connection section having the above-described structure, the end part of the contact interface of the connection member 506 and the diffusion prevention layer 510 is covered by the connection member 506 and the protection layer 512, as shown in FIG. 4G. In other words, any part of the diffusion prevention layer 510 that is held in contact with the connection member 506 is not exposed at all. Therefore, the diffusion prevention layer 510 is never brought into contact with any chemical liquid such as etching liquid so that undercutting of the diffusion prevention layer can reliably be prevented from taking place and contact corrosion between dissimilar metals is also prevented from taking place there. Additionally, because the upper surface of the outer peripheral edge of the diffusion prevention layer 510 is flush with the upper surface of the protection layer 512, the step, if any, of the connection member 506 that arises in the region thereof covering the outer peripheral edge of the diffusion prevention layer 510 is minimized and hence the connection member 506 shows an excellent surface coverage effect. For the above-described reasons, the present disclosure can provide a highly reliable electrical connection section.

The use of highly reliable Au is preferable for the material for forming the connection member of the electrical connection section. The use of TiW is preferable for the material for forming the diffusion prevention layer.

Now, a substrate for liquid ejection head according to the present disclosure that is provided with an electrical connection section as described above will now be described hereunder by referring to FIGS. 1 and 2.

Figure 1:
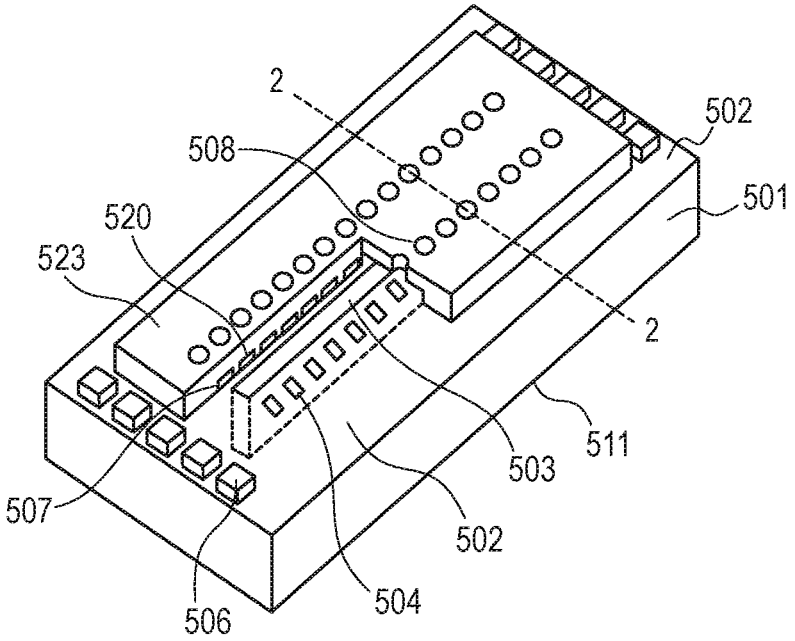
FIG. 1 is a schematic perspective view of an exemplar embodiment of substrate for liquid ejection head according to the present disclosure.
Figure 2:
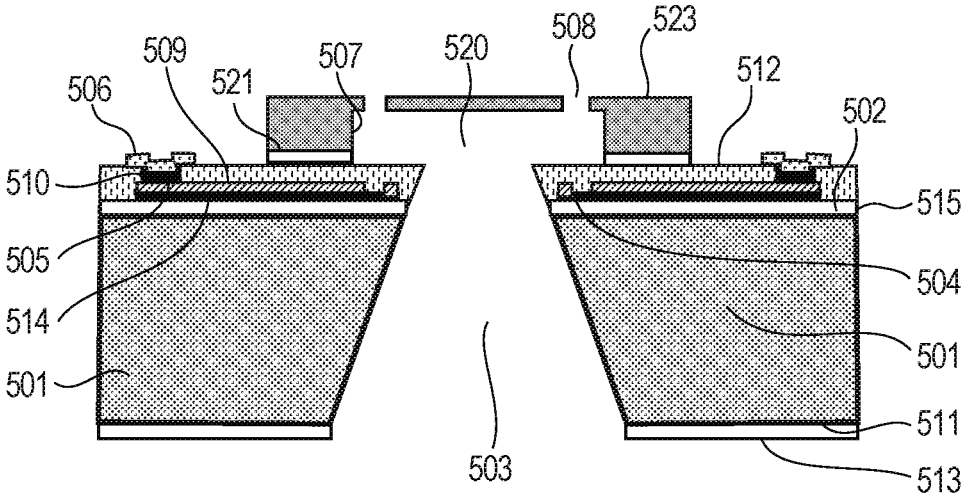
FIG. 2 is a schematic cross-sectional view of the substrate for liquid ejection head shown in FIG. 1 and taken along line 2-2 in FIG. 1.

As shown in FIGS. 1 and 2, the substrate for liquid ejection head comprises a substrate 501, electric wiring, a member 523 having liquid chambers 520 to be filled with ink and ejection orifices 508 for ejecting ink and other members are formed on the front surface 502 of the substrate 501. An Si substrate having a thickness between 0.3 and 1.0 mm may typically be employed for the substrate 501. An ink supply port 503, which is an oblong groove-like through hole for receiving liquid fed from the outside and guiding the liquid into the liquid chambers 520, is open at the front surface 502 of the substrate 501. A row of liquid ejection energy generating elements 504 is arranged on each of the opposite sides of the ink supply port 503 the substrate front surface 502. The liquid ejection energy generating elements 504 of the two rows may be arranged symmetrically or in a staggered manner. The ejection orifices 508 can also selectively be arranged to match the arrangement of the liquid ejection energy generating elements 504.

Each of the liquid chambers 520 is so formed as to communicates with the ink supply port 503 and contain the corresponding liquid ejection energy generating elements 504 of the two rows of liquid ejection energy generating elements 504 that are arranged respectively on the opposite sides of the ink supply port 503. Each of the liquid chambers 520 is surrounded by a flow path wall 507 that defines an ink flow path, whose cross section extends from the ink supply port 503 and gets to a position located above the rows of liquid ejection energy generating elements 504. The ejection orifices 508 are open above the respective liquid ejection energy generating elements.

Additionally, an electric wiring layer 509, which is typically made of aluminum (Al), is formed on the substrate front surface 502 by way of an insulating oxide film layer 515 in order to supply electric power to the liquid ejection energy generating elements 504. The electric wiring layer 509 has a plurality of electrode sections 505 that are connected to an external electric power supply source. The electrode sections 505 are arranged in two rows running along the respective edges of the substrate front surface 502 in the longitudinal direction of the substrate. Connection members 506 that are typically made of gold (Au) are arranged respectively on the electrode sections 505 with a diffusion prevention layer 510 interposed between the connection members 506 and the electrode sections 505.

When forming Au connection members 506, a diffusion prevention layer 510 is arranged between the electrode sections 505 and the Au connection members 506 in order to minimize degradation of the connection reliability of the Au connection members 506 due to diffusion of Al of the electrode sections 505 into the Au of the connection members 506. The diffusion prevention layer is formed by using a metal material such as TiW or the like (barrier metal for the connection members) The Au connection members 506 are generally formed on the diffusion prevention layer 510 by means of sputtering or bump plating of Au. If the Au connection members 106 are formed after forming the liquid chambers and executing the process of forming the ink supply port, it is difficult to execute a highly accurate process, using photolithography, because holes and steps of 5 to 100 μm are already present on the substrate. For this reason, preferably, the manufacturing step of forming Au connection members is conducted first and thereafter the ink flow paths and the liquid chambers 520 are formed and the process of forming the ink supply port 503 is executed.

Now, an embodiment of method of manufacturing a substrate for liquid ejection head will be described below by referring to the related drawings.

This embodiment of manufacturing a substrate for liquid ejection head comprises a step of forming an insulation layer on the wiring layer arranged on the substrate, a step of forming a first resist mask having insulation-layer-exposing openings on the insulation layer and a step of executing an etching process relative to the insulation layer exposed from the openings of the first resist mask so as to get to the wiring layer. The above-listed steps will be described below by referring to FIGS. 3A through 3C.

First, a substrate 501 having liquid ejection energy generating elements 504 on the side of the first surface 502 of the substrate 501 as shown in FIG. 3A is prepared.

A silicon (100) substrate can be used for the substrate 501. A pair of electric wiring layers 509, which are typically made of Al, for supplying electric power to each of the liquid ejection energy generating elements 504 are formed on the substrate front surface 502 with an insulating oxide film layer 515 interposed between the substrate front surface 502 and the electric wiring layers 509. A protection layer (insulation layer) 512 for protecting the electric wiring layers 509 and the liquid ejection energy generating elements is formed on the uppermost surface. Additionally, an oxide film 513 is formed on the second surface, or the rear surface, of the substrate 501.

Then, as shown in FIG. 3C, openings are formed in the protection layer (insulation layer) 512 for the purpose of forming electrode sections 505 there. For forming the openings, photoresist is applied to the entire surface of the substrate to produce a resist layer 530 on the protection layer (insulation layer) as shown in FIG. 3B.

Subsequently, as shown in FIG. 3C, the protection layer 512 on the substrate 501 is made to show a predetermined profile by means of a dry etching technique that involves the use of photolithography. For the photolithography, the resist layer 530 is partly exposed to light by means of a patterning mask and exposure equipment and thereafter subjected to a development process to produce a patterned resist layer 530 (resist pattern) so as to expose only the parts of the resist layer 530 that correspond to the electrode sections 505. Then, the exposed parts of the protection layer 512 are etched by means of a dry etching technique, using the resist layer 530 as etching mask (the first etching mask). With the above-described processes, it is possible to produce electrode sections 505 where the Al wiring layers 509 are exposed with the resist layer 530 remaining on the substrate except the areas of the electrode sections 505.

Thereafter, connection members 506 are formed respectively on the electrode sections 505 with a diffusion prevention layer 510 interposed between the connection members 506 and the electrode sections 505.

Such connection members 506 can be formed by this embodiment of manufacturing method, which comprises a step of forming a diffusion prevention layer so as to cover the wiring layer exposed from the openings of the first resist mask and the first resist mask, a step of removing the first resist mask along with the diffusion prevention layer arranged on the first resist mask by way of a lift-off process, a step of forming a metal layer to cover the diffusion prevention layer left on the wiring layer, a step of forming a second resist mask on the metal layer and a step of forming connection members to respectively cover the outer peripheral edges of the diffusion prevention layer by executing a wet etching process relative to the metal layer.

The above-described steps of forming connection members will now be described in greater detail by referring to FIGS. 4A through 4C. Subsequently, a step of forming a flow path forming member having ejection orifices and liquid chambers that immediately comes after the step of forming connection members will be described by referring to FIGS. 4H through 4R. Note that FIGS. 4A through 4G are enlarged schematic cross-sectional views (taken along a plane that is perpendicular to line 2-2 in FIG. 1), showing only one of the Al electrode sections 505 and its vicinity illustrated in FIGS. 2 and 3C. FIGS. 4A through 4G are provided to make it easier to understand the processing steps for forming the Al electrode sections 505.

FIG. 4A is an enlarged schematic partial cross-sectional view of one of the electrode sections shown in FIG. 3C and its vicinity. In the state of the electrode sections shown in FIG. 3C, after forming openings in the protection layer 512, the resist layer 530 that is employed as etching mask is left there.

Then, with regard to the part of the substrate as shown in FIG. 4B, a diffusion prevention layer (TiW layer) 510 is formed by sputtering.

Subsequently, resist stripping liquid is made to penetrate into the inside of the resist layer 530 by way of the parts of the resist layer 530 that are not sufficiently covered by the diffusion prevention layer (TiW layer) 510 (corners and parts having a stepped profile) in order to dissolve the resist layer 530. Then, as a result, the diffusion prevention layer 510 adhering onto the resist layer 530 (onto the resist mask) is separated and stripped off when washed. Consequently, the diffusion prevention layer 510 is cut along the boundary of the area that is free from the resist layer and the area where the resist layer exists and the diffusion prevention layer 510 is allowed to remain only in the area that is free from the resist layer as shown in FIG. 4C. Through such a lift-off process, the profile of the opening of the protection layer 512 comes to completely agree with the profile of the corresponding area of the diffusion prevention layer 510 and the surface level of the protection layer 512 comes to agree with the surface level of the peripheral edge of the diffusion prevention layer 510. In other words, they become to be flush with each other. When the surface level of the protection layer 512 is made to agree with the surface level of the peripheral edges of the diffusion prevention layer 510 in this way, no step is produced on the connection member (Au layer) along the peripheral edge of the diffusion prevention layer (TiW) 510 that will be produced by way of a process of forming the connection member (Au layer) 506 that comes later to consequently improve the effect of surface coverage of the connection members (Au layer) 506.

Then, a metal layer (Au layer) 506 that turns to be a connection member is formed by sputtering as shown in FIG. 4D.

Thereafter, a resist layer 530 is formed on the area of the metal layer 506 that turns to be an electrode section as mask (second resist mask) as shown in FIG. 4E. This resist layer 530 can be formed in a manner as will be described below. First, photoresist is applied onto the entire surface of the substrate by spin coating to produce a coating film layer on the metal layer. Subsequently, a resist layer 530 is formed by photolithography using a patterning mask and only the area that turns to be a connection member (Au electrode pad) is masked.

Then, as shown in FIG. 4F, a connection member (Au layer) 506 is formed to show a predetermined profile by wet etching. Thereafter, the resist layer 530 that is employed as mask is removed by means of resist stripping liquid to produce a connection member (Au electrode pad) 506 having a predetermined profile as shown in FIG. 4G. Thus, as a result, the peripheral edge of the diffusion prevention layer (TiW layer) is covered by the connection member (Au electrode pad) 506 that operates as upper layer so that the peripheral edge would never directly be brought into contact with any liquid and hence no undercutting would take place.

Thereafter, the steps of forming a flow path forming member, nozzles and so on follow. These steps will sequentially be described below by referring to the related drawings.

Figure 4H:
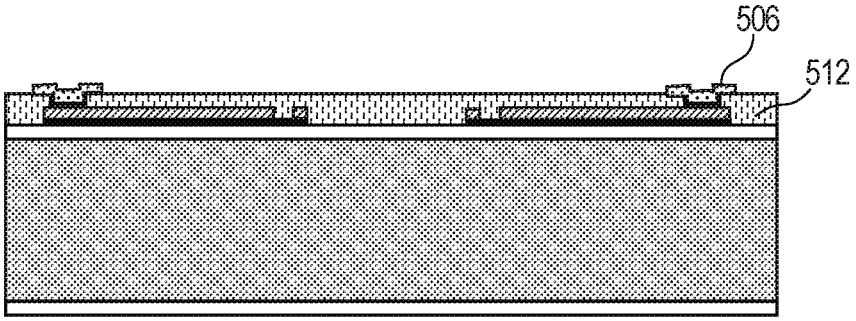

FIG. 4H shows a state of the liquid ejection head that corresponds to completion of the manufacturing step illustrated in FIG. 4G. More specifically, FIG. 4H is a cross-sectional view taken along a plane that is perpendicular to line 2-2 in FIG. 1.

Figure 4I:
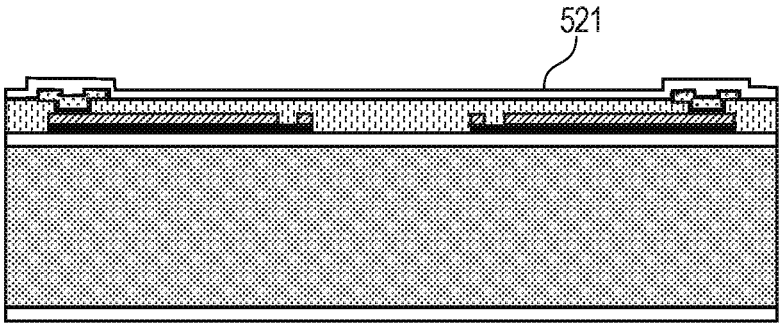

First, as shown in FIG. 4I, an adhesion improvement layer 521 is formed on the entire surface of the substrate. The formation of the adhesion improvement layer can be realized by using a high thermostability coating material. Then, as a result, the adhesion of the members on the substrate and the flow path forming member that will be formed in a later step can be improved.

Figure 4J:
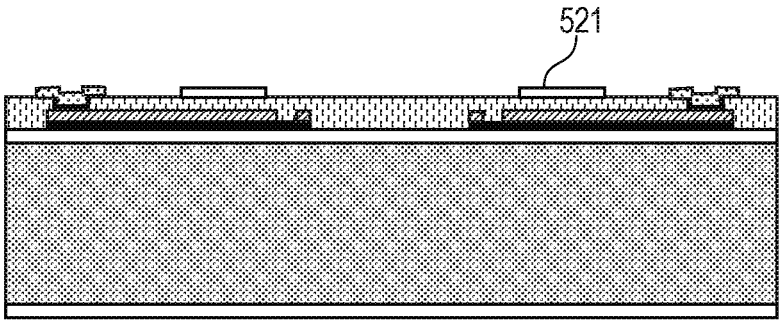

Subsequently, as shown in FIG. 4J, the adhesion improvement layer 521 is subjected to a patterning process so as to make it show a predetermined profile. More specifically, to begin with, photoresist is applied onto the adhesion improvement layer 521 and the applied photoresist film is partly exposed to light by means of photolithography and then developed to produce a mask pattern that is made from the resist layer. Then, the adhesion improvement layer 521 is partially etched by means of dry etching to make it show a predetermined profile. Thereafter, the resist layer that has served as mask is removed by means of resist stripping liquid and the resist stripping liquid on the substrate is rinsed off by pure water. At this time, since the lateral surface of the diffusion prevention layer (TiW layer) 510 located under the connection members (Au layer) 506 is not brought into contact with the alkaline resist stripping liquid, the risk, if any, of damaging and/or side etching the diffusion prevention layer (TiW layer) 510 that can occur to the lateral surface of the diffusion prevention layer can be minimized.

Figure 4K:
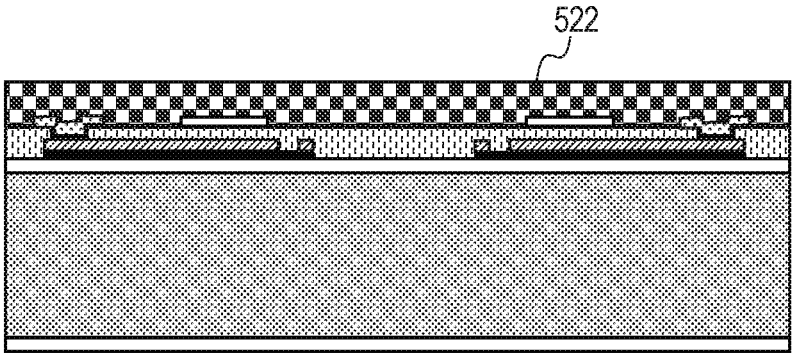
Figure 4L:
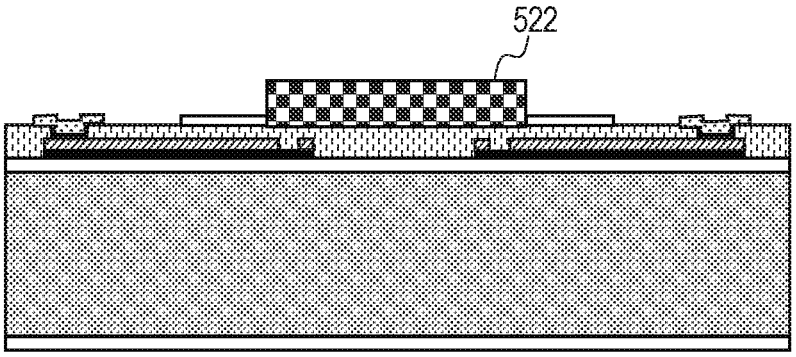

Then, as shown in FIG. 4K, a molding layer of a molding (a member that will ultimately be removed) 522 to be used to produce a mold for forming liquid chambers 520, which are defined by a flow path wall 507, is formed. More specifically, to begin with, photosensitive resin is applied onto the substrate 501 and then the applied film is partly exposed to light by means of exposure equipment and then developed to make it show a predetermined profile (FIG. 4L). After the development process, the applied photosensitive resin is preferably baked at the temperature of about 50° C. for a predetermined period of time.

Figure 4M:
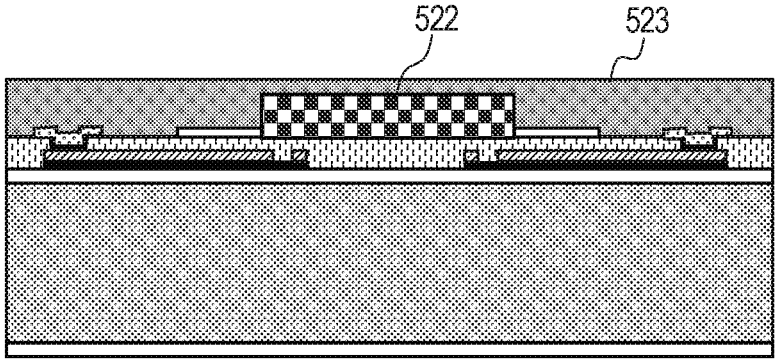
Figure 4N:
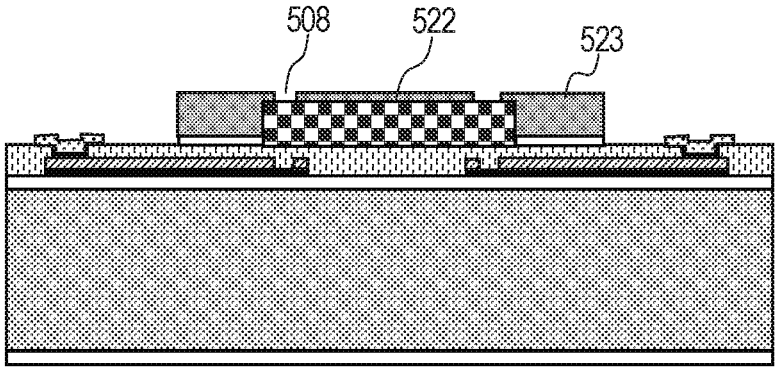

Thereafter, as shown in FIG. 4M, a flow path forming member layer for forming a flow path forming member 523 is formed on the substrate 501. More specifically, to begin with, a photosensitive resin composition is applied to the substrate 501 so as to cover the molding 522. Subsequently, the photosensitive resin composition layer (flow path forming member layer 523) is partly exposed to light by means of exposure equipment and then developed to form a flow path forming member 523 having ejection orifices 508 as shown in FIG. 4N. After the development process, the applied photosensitive resin composition is preferably baked at a temperature of about 90° C. for a predetermined period of time.

Figure 4O:
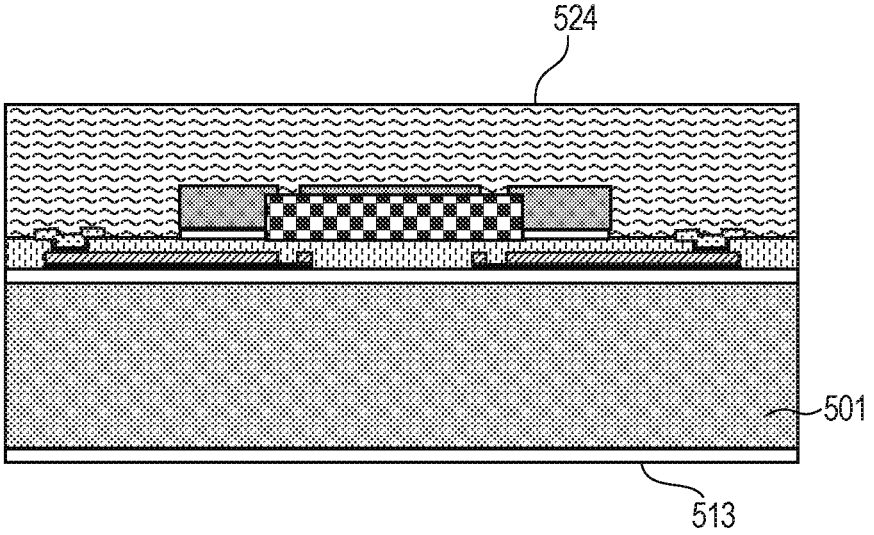
Figure 4P:
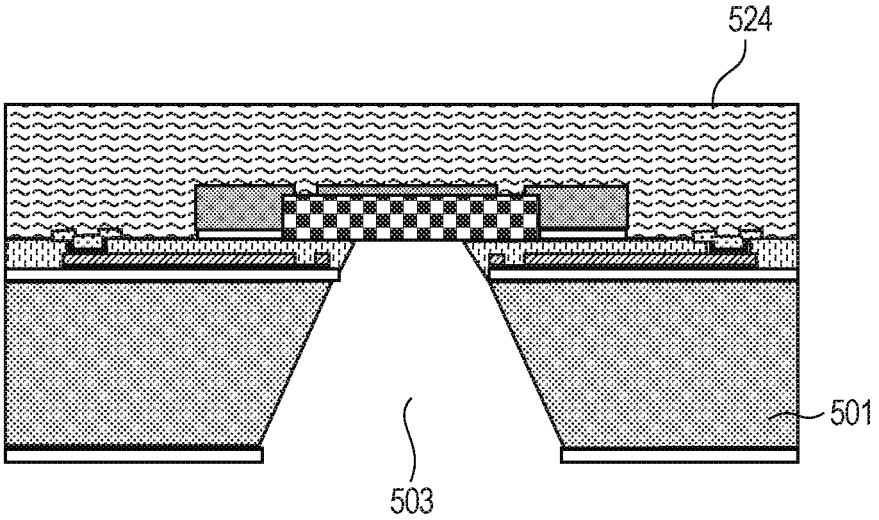

Then, an ink supply port 503 is formed in the substrate 501 as shown in FIGS. 4O and 4P. More specifically, to begin with, an etching protection layer 524 is formed so as to cover the front surface of the substrate 501 as shown in FIG. 4O. Such an etching protection layer 524 can be formed by applying a thermosetting resin material and then heating the resin material to cure it.

Subsequently, as shown in FIG. 4P, the ink supply port 503 is produced by etching the substrate 501. More specifically, to begin with, photoresist is applied to the rear surface of the substrate 501 by spin coating and then exposed to light and developed to produce a resist pattern to be used to etch the oxide film 513. Then, an opening is formed at a part of the oxide film 513 that corresponds to the ink supply port 503 by partly removing the oxide film 513 by means of chemical liquid such as buffered hydrofluoric acid. After removing the resist pattern, the ink supply port 503 is produced by means of anisotropic etching and substantially the insulating oxide film 515 and the protection layer 512 on the ink supply port 503 are removed by means of chemical liquid such as buffered hydrofluoric acid.

Figure 4Q:
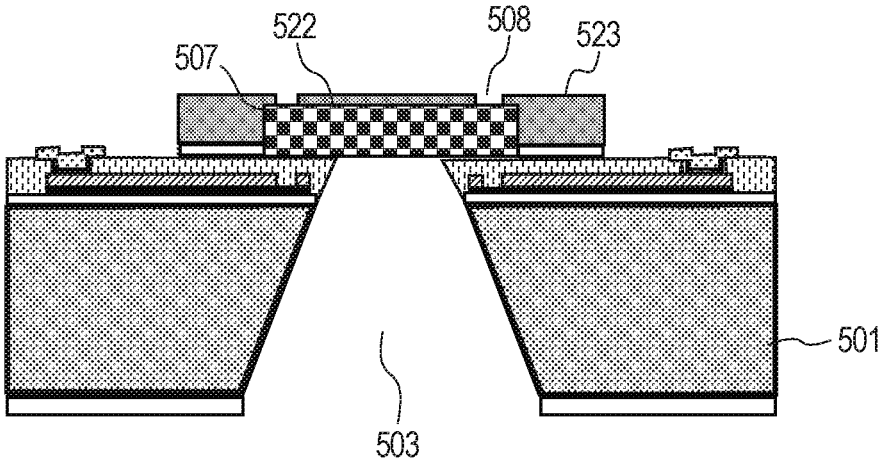
Figure 4R:
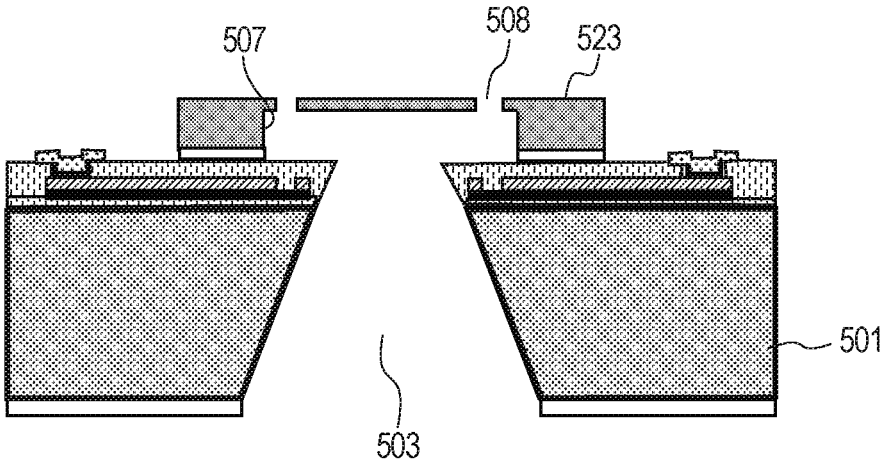

Then, as shown in FIG. 4Q, the etching protection layer 524 is dissolved and removed by means of a solvent such as xylene. Subsequently, as shown in FIG. 4R, the molding 522 is dissolved and removed by means of a solvent such as methyl lactate (to consequently produce liquid chambers). Thereafter, the flow path forming member 523 is hardened further by baking it at a temperature of about 200° C. for a predetermined period of time to produce a finished substrate for liquid ejection head.

A substrate for liquid ejection head and a method of manufacturing such a substrate for liquid ejection head as described above can respectively be applied to a substrate for inkjet head, which is a principal component of an inkjet head, and a method of manufacturing a substrate for inkjet head. Additionally, the configuration of the electrical connection section of a substrate for liquid ejection head and a method of manufacturing a substrate for liquid ejection head as described above can be applied to a substrate with an electrical connection section that can be used for semiconductor devices and micro machining devices and a method of manufacturing such a substrate with an electrical connection section.

Example

Now, an example of method of manufacturing a substrate for liquid ejection head will be described below for the purpose of describing the present disclosure in greater detail.

First, a substrate 501 having liquid ejection energy generating elements 504, which were made of TaSiN, on the side of the first surface 502 of the substrate 501 as shown in FIG. 3A was prepared.

A silicon (100) substrate was employed for the substrate 501. An Al wiring layer 509 was formed on the substrate front surface 502 with an insulating oxide film layer 515 interposed between them. The Al wiring layer 509 served as wiring for supplying electric power to each of the liquid ejection energy generating elements 504. An SiN-made protection layer 512 was formed on the uppermost surface of the substrate 501 for the purpose of protecting the Al wiring layer 509 and the liquid ejection energy generating elements. The protection layer 512 was formed by means of plasma CVD. Additionally, an oxide film 513 was formed by thermal oxidation on the rear surface, or the second surface, of the substrate 501.

Subsequently, as shown in FIG. 3C, openings were formed in the SiN-made protection layer 512 for the purpose of forming electrode sections 505. To form the openings, to begin with, photosensitive resin (photoresist) available from TOKYO OHKA KOGYO Co., Ltd. was applied to the entire surface of the substrate to a thickness of 1 μm by spin coating to form a resist layer 530 on the substrate 501.

Then, as shown in FIG. 3C, the SiN-made protection layer 512 on the substrate 501 was subjected to a drying etching process, using a photolithography technique, to make it show a predetermined profile. With the photolithography, the resist layer 530 was partly exposed to light by using a patterning mask and exposure equipment and thereafter developed to produce a patterned resist layer 530 and allow only parts thereof that respectively correspond to the electrode sections 505 on the substrate 501 to be exposed to the outside. Thereafter, the exposed parts of the SiN-made protection layer 512 were etched out by means of a dry etching technique using a $CF_4$ gas, by using the resist layer 530 as etching mask. Then, as a result, electrode sections 505 where the Al wiring layer 509 was exposed were produced with the resist layer 530 remaining on the substrate 501.

Then, an Au layer (connection members) 506 was formed on the electrode sections 505 by way of a TiW layer (diffusion prevention layer) 510. This manufacturing process will now be described below by referring to FIGS. 4A through 4C. Thereafter, the manufacturing process of producing a flow path forming member having ejection orifices and liquid chambers that follows the foregoing manufacturing process will be described by referring to FIGS. 4H through 4R. Note that FIGS. 4A through 4G are enlarged schematic cross-sectional views (taken along a plane that is perpendicular to line 2-2 in FIG. 1), showing only one of the Al electrode sections 505 and its vicinity illustrated in FIGS. 2 and 3C. FIGS. 4A through 4G are provided to make it easier to understand the step of processing the electrode section and its vicinity.

FIG. 4A is an enlarged schematic partial view of one of the electrode sections 505 and its vicinity in a state that corresponds to the state thereof shown in FIG. 3C. In the state illustrated in FIG. 4A, an opening had been formed in the protection layer 512 and the resist layer 530 that had been employed as etching mask was left there.

Subsequently, a TiW layer 510 was formed to a thickness of 150 nm by sputtering as shown in FIG. 4B.

Thereafter, resist stripping liquid was made to penetrate into the inside of the resist layer 530 through the part of the resist layer 530 that was not sufficiently covered by the diffusion prevention layer (TiW layer) 510 in order to dissolve the resist layer 530. Then, as a result, the TiW layer 510 that had been adhering to the resist layer 530 was separated from the resist layer 530 and peeled off when washed. Consequently, the TiW layer 510 was cut along the boundary of the part thereof where the resist layer had not existed and the part thereof where the resist layer had existed and the TiW layer 510 was made to remain only in the part thereof where the resist layer had not existed. Then, as a result, the size of the opening of the protection layer 512 was made to agree with the size of the exposed TiW layer 510 and the height of the protection layer 512 was made to agree with the height of the peripheral edge of the TiW layer 510 to produce a flat surface. Since the height of the protection layer 512 and the height of the peripheral edge of the TiW layer 510 were made to agree with each other, no step was produced on the Au layer at the peripheral edge of the TiW layer in the process of forming the Au layer 506 that came thereafter to consequently improve the effect of surface coverage of the Au layer 506.

Subsequently, as shown in FIG. 4D, the Au layer 506 was formed to a thickness of 300 nm by means of sputtering.

Then, as shown in FIG. 4E, a resist layer 530 was formed as mask on the part on the Au layer 506 that was to turn to be an electrode section. More specifically, the resist layer 530 was formed in a manner as described below. To begin with, photosensitive resin (photoresist) available from TOKYO OHKAKOGYO Co., Ltd. was applied to the entire surface of the substrate to a thickness of 2 μm by spin coating. Thereafter, a resist layer 530 was formed by means of photolithography, using a patterning mask, and only the part that was to turn to be an electrode section was masked.

Then, as shown in FIG. 4F, the Au layer was subjected to a wet etching process, using iodine, to produce an Au connection member 506 having a predetermined profile. Subsequently, as shown in FIG. 4G, the resist layer 530 that was employed as mask was removed by means of resist stripping liquid to obtain the Au connection member (electrode pad) 506 as shown in FIG. 4G. Then, as a result, the peripheral edge of the TiW layer (diffusion prevention layer) 510 was covered by the Au connection member (electrode pad) 506, which was laid on the TiW layer 510, so that the TiW layer 510 was never brought into direct contact with liquid. Thus, no undercutting occurred to the TiW layer 510.

Then, a step of producing a flow path forming member and a step of forming nozzles followed thereafter. These steps will be described below by referring to the related drawings.

FIG. 4H shows a state of the substrate that corresponds to the time when the process of producing the profile as shown in FIG. 4G was over. More specifically, FIG. 4H is a schematic cross-sectional view of the substrate taken along a plane that is perpendicular to line 2-2 in FIG. 1.

First, an adhesion improvement layer 521 was formed on the entire surface of the substrate 1 as shown in FIG. 4I. A highly heat-resistant coating material (HIMAL: trade name, available from Hitachi Chemical) was employed to form the adhesion improvement layer 521 to a thickness of 2 μm by spin coating. Then, as a result, the adhesion between the members on the upper side of the substrate and the flow path forming member that was formed in a later stage was improved.

Subsequently, the adhesion improvement layer 521 was subjected to a patterning process to make it show a predetermined profile as shown in FIG. 4J. More specifically, to begin with, photoresist available from TOKYO OHKA KOGYO Co., Ltd. was applied onto the adhesion improvement layer 521 to a thickness of 5 μm by spin coating. Thereafter, the applied film of photoresist was partly exposed to light and then developed by means of photolithography to produce a mask pattern that was made from the photoresist. Then, the adhesion improvement layer 521 was etched by dry etching in order to make it show a predetermined profile. Thereafter, the resist layer that was employed as mask was removed by alkaline resist stripping liquid (REMOVER 1112A: trade name, available from Rohm and Haas Company) and then rinsed off by pure water. At this time, the lateral surface of the TiW layer 510 that was laid under the Au layer 506 was not brought into contact with the alkaline resist stripping liquid and hence neither damage nor side etching occurred to the lateral surface of the TiW layer 510.

Then, as shown in FIG. 4K, a molding layer for producing a molding 522 (a member that was to be ultimately removed) of a mold of the liquid chambers 520 that were defined by a flow path wall 507 was formed. More specifically, to begin with, polymethyl isopropenyl ketone was applied onto the substrate 501 to a thickness of 20 μm by spin coating. Subsequently, the applied film was partly exposed to light by means of exposure equipment (UX-3300: trade name, available from Ushio Inc.) and then developed to make it show a predetermined profile (FIG. 4L). The employed exposure light was deep UV light with a wavelength of not greater than 400 nm and the exposure was made to be equal to 5,000 $J/m^2$. After development, the molding was baked at 50° C. for 5 minutes.

Thereafter, as shown in FIG. 4M, a flow path forming member layer for forming a flow path forming member 523 was formed on the substrate 501. More specifically, to begin with, a photosensitive resin composition was applied to the substrate 501 by means of spin coating so as to cover the molding 522. The photosensitive resin composition was prepared by dissolving epoxy resin (157S70: trade name, available from Japan Epoxy Resin) and photo acid generator (LW-S1: trade name, available from San-Apro Ltd.) into xylene. The part of the layer of the photosensitive resin composition (flow path forming member layer 523) located on the molding 522, which corresponds to liquid chambers, showed a thickness of 10 μm and the other part of the layer of the photosensitive resin composition showed a thickness of 15 Subsequently, the layer of the photosensitive resin composition (flow path forming member layer 523) was partly exposed to light by means of exposure equipment (FPA-3000i5+: trade name available from Canon) and then developed to produce the flow path forming member 523 having ejection orifices 508 as shown in FIG. 4N. The wavelength of the light used for the exposure was 365 nm and the exposure was made to be equal to 20 $J/m^2$. After development, the molding was baked at 90° C. for 5 minutes.

Then, as shown in FIG. 4O and FIG. 4P, an ink supply port 503 was formed on the substrate 501. More specifically, to begin with, an etching protection layer 524 was formed so as to cover the front surface of the substrate 501, as shown in FIG. 4O. To form the etching protection layer 524, firstly cyclized rubber was applied to the substrate 501 to a thickness of 40 μm and subsequently baked to cure the cyclized rubber at 90° C. for 30 minutes.

Thereafter, as shown in FIG. 4P, the ink supply port 503 was produced by etching the substrate 501, using alkaline chemical liquid TMAH (tetramethyl ammonium hydroxide) that allowed to perform anisotropic wet etching on Si. More specifically, to begin with, a resist pattern for etching the oxide film 513 was formed on the rear surface of the substrate 501 by applying photosensitive resin (photoresist) available from TOKYO OHKA KOGYO Co., Ltd. to the rear surface of the substrate 501 to a thickness of 1 μm by means of spin coating and subsequently exposing the photosensitive resin to light and then developing it. Then, an opening was formed in the oxide film 513 at the position that corresponds to the part of the substrate 501 where the ink supply port 503 was to be formed by partly removing the oxide film 513 by means of buffered hydrofluoric acid, using the resist pattern as mask. After removing the resist pattern, the ink supply port 503 was produced by means of anisotropic etching, using 20% aqueous solution of TMAH that was heated to 83° C. and then the insulating oxide film layer 515 and the protection layer 512 on the ink supply port 503 were removed by means of buffered hydrofluoric acid.

Then, as shown in FIG. 4Q, the etching protection layer 524 was dissolved and removed by means of xylene. Thereafter, as shown in FIG. 4R, the molding 522 was dissolved and removed by means of methyl lactate. Subsequently, the flow path forming member 523 was hardened further by baking it at 200° C. for 1 hour to produce a finished substrate for liquid ejection head.

Thus, a substrate for liquid ejection head that was equipped with a highly reliable electrical connection section could be prepared with the TiW layer (diffusion prevention layer) 510 that was prevented from being undercut at the time of wet etching operation for forming Au connection members 506.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-158553, filed Aug. 30, 2019, which is hereby incorporated by reference herein in its entirety.

What is claimed is:

1. A substrate with an electrical connection section comprising:

a wiring layer;

a diffusion prevention layer laid on the wiring layer;

a connection member laid on the diffusion prevention layer, the connection member establishing an electrical connection to an outside; and an insulation layer having a wiring-layer-exposing opening arranged on the wiring layer;

the diffusion prevention layer being arranged in the opening; and the connection member being arranged on the diffusion prevention layer so as to cover an outer peripheral edge of the diffusion prevention layer, wherein the diffusion prevention layer is arranged in the opening with its outer peripheral edge running along an inner periphery of the opening and an upper surface of the outer peripheral edge of the diffusion prevention layer is flush with an upper surface of the insulation layer.

2. The substrate with an electric connection section according to claim 1, wherein the connection member is formed with Au.

3. The substrate with an electric connection section according to claim 1, wherein the diffusion prevention layer is a TiW layer.

4. A substrate for liquid ejection head equipped with an electric connection section, comprising:

a wiring layer;

a diffusion prevention layer laid on the wiring layer;

a connection member laid on the diffusion prevention layer, the connection member establishing an electrical connection to an outside; and an insulation layer having a wiring-layer-exposing opening arranged on the wiring layer;

the diffusion prevention layer being arranged in the opening; and the connection member being arranged on the diffusion prevention layer so as to cover an outer peripheral edge of the diffusion prevention layer, wherein the diffusion prevention layer is arranged in the opening with its outer peripheral edge running along an inner periphery of the opening and an upper surface of the outer peripheral edge of the diffusion prevention layer is flush with an upper surface of the insulation layer.

5. The substrate for liquid ejection head according to claim 4, wherein the connection member is formed with Au.

6. The substrate for liquid ejection head according to claim 4, wherein the diffusion prevention layer is a TiW layer.

7. The substrate with an electric connection section according to claim 1, wherein the upper surface of the outer peripheral edge of the diffusion prevention layer is coplanar with the upper surface of the insulation layer.

8. The substrate for liquid ejection head according to claim 4, wherein the upper surface of the outer peripheral edge of the diffusion prevention layer is coplanar with the upper surface of the insulation layer.

* * * * *